United States Patent [19]

Kato et al.

[11] Patent Number: 4,959,952

[45] Date of Patent: Oct. 2, 1990

[54] OPERATION STARTING METHOD FOR SPINNING MACHINE

[75] Inventors: Hisaaki Kato, Shiga; Hiroshi Yamaguchi, Kyoto; Hideshi Mori, Joyo; Akira Shimano, Kyoto, all of Japan

[73] Assignee: Murata Kikai Kabushiki Kaisha, Kyoto, Japan

[21] Appl. No.: 183,976

[22] Filed: Apr. 20, 1988

[30] Foreign Application Priority Data

| | | | |
|---|---|---|---|
| Apr. 22, 1987 | [JP] | Japan | 62-99450 |
| Jun. 4, 1987 | [JP] | Japan | 62-140607 |
| Jul. 6, 1987 | [JP] | Japan | 62-104273 |
| Dec. 29, 1987 | [JP] | Japan | 62-334202 |

[51] Int. Cl.[5] ..... D01H 15/00; D01H 1/115

[52] U.S. Cl. ..... 57/261; 57/280; 57/328; 57/336

[58] Field of Search ..... 57/261, 328, 279, 280, 57/336

[56] References Cited

U.S. PATENT DOCUMENTS 4,674,274 6/1987 Kato ..... 57/328

*Primary Examiner*—John Petrakes

*Attorney, Agent, or Firm*—Spensley Horn Jubas & Lubitz

[57] ABSTRACT

An operation starting method for a spinning machine of the type wherein a draft device, an air jetting nozzle and a false twisting device of the nip belt type are disposed in this order, constituted such that, in a condition of the false twisting device wherein belts are held in contact with each other at a nip point, when operation of the spinning machine is started, an air flow directed toward the false twisting device is produced on the air jetting nozzle side of the false twisting device while another air flow directed away from the false twisting device is produced on the opposite side of the false twisting device to the air jetting nozzle.

16 Claims, 4 Drawing Sheets

8
23
24
25
26
27
28
29
31
32
33
34
35
36
37
38
39
41
42
43
44
45
46
47
48
49
50
51
52
53
54
55
56
57
58
59
61
Y

OPERATION STARTING METHOD FOR SPINNING MACHINE

FIELD OF THE INVENTION

This invention relates to an operation starting method for a spinning machine, and more particularly to a yarn introducing method into a false twisting device in a spinning machine wherein a draft device, an air jetting nozzle and a false twisting device of the nip belt type are disposed in this order.

RELATED ART STATEMENT

Development of various spinning machines with the object of improvement in spinning speed, reduction in number of spinning steps or improvement in quality of product yarn has been attempted for conventional ring spinning machines, and various spinning machines such as open end spinning machines and pneumatic spinning machines have been already proposed. As a representative one of such pneumatic spinning machines, there is an arrangement wherein two air flows which whirl in different directions from each other and act upon a bundle of fibers to twist the fiber bundle to produce spun yarn. According to the pneumatic spinning machine, spinning at a high speed by several times the speed attained in a ring spinning machine is enabled, and, if the pressure of an air flow is raised, the spinning speed will be raised even further. However, if an attempt is made to raise the spinning speed to a large extent, energy consumption will increase steeply, and accordingly a difficulty problem occurs. Thus, development of a new spinning machine which can resolve the problem is needed. As an exemplary one of the arrangements developed so as to meet the demand, there is a spinning machine which is mentioned hereinafter. This arrangement includes an air jetting nozzle for causing a whirling air flow in one direction to act upon a fiber bundle forwarded from a draft device, and a false twisting device of the belt type for false twisting the fiber bundle forwarded from the nozzle.

A spinning machine which includes such a false twisting device of the belt type as described above has advantages that the false twisting efficiency is high because the false twisting device directly nips and false twists a fiber bundle, that yarn break seldom occurs because the false twisting device applies a forwarding force to a fiber bundle, and so on, and it has been confirmed that, due to the reasons described just above, the spinning machine can exhibit a spinning capacity of a higher speed than an ordinary pneumatic spinning machine.

In the spinning machine, however, there is a problem that, since a fiber bundle forwarded from the air jetting nozzle is an assembly consisting of a large number of single fibers as distinct from a filament, it is difficult upon starting of operation of the spinning machine to smoothly introduce an end of the fiber bundle into the false twisting device of the belt type and smoothly start application of a false twisting acting force by the false twisting device of the belt type to the fiber bundle.

In particular, in the case of a filament, since the filament itself has a sufficient rigidity, it is possible to guide and position the filament to a predetermined yarn path in advance by means of a guide member or the like and move a pair of belts of the false twisting device of the belt type toward each other so as to hold the filament therebetween. In this condition, operation of the spinning machine can be started readily. To the contrary, in the case of such a fiber bundle as described above, it is not yet formed into yarn and hence does not itself have a sufficient rigidity at a point of time when it is forwarded from the air jetting nozzle. Accordingly, it is difficult for the fiber bundle to pass over a predetermined distance in a space in which no guide member is provided after it has been forwarded from the air jetting nozzle (that is, a distance of the width occupied by the false twisting device of the belt type). Even if the fiber bundle is passed successfully in the air, the probability of success in moving the belts toward the fiber bundle, so to speak, flying in the air until they hold the fiber bundle from the opposite sides therebetween in order to start twisting is still very low because the fiber bundle itself does not have a rigidity sufficient to maintain the shape of continuous yarn as described hereinabove and because it is difficult to reach coincidence between the center of holding by the belts and the locus of movement of the fiber bundle due to the fact that the fiber bundle is moved at a high speed.

Thus, the inventor of the present invention have developed an idea that a pair of belts of a belt type false twisting device are held in contact with each other from the beginning of a twisting operation so that the contacting location may serve as, so to speak, a guide member along which a fiber bundle forwarded from an air jetting nozzle is passed. Such an arrangement has been actually tried, but it has been found that, unless the contacting pressure of the belts is very low, a fiber bundle just after forwarded from the air jetting nozzle cannot pass between the belts well. Furthermore, since the contacting pressure is low, a sufficient twisting action cannot be applied to the fiber bundle and consequently satisfactory spun yarn is not produced even if the fiber bundle can pass between the belts. Also, it has been found that where the contacting pressure of the belts is set to the contrary to a sufficiently high level in order to apply a sufficient twisting action to a fiber bundle from the beginning, even if the speed of the fiber bundle forwarded from the air jetting nozzle is raised progressively, the fiber bundle only collides violently with end faces of the belts. Accordingly such ideal yarn introduction wherein the fiber bundle advances between the belts well and passes straightforwardly to the rear between the belts is not realized.

OBJECT AND SUMMARY OF THE INVENTION

It is an object of the present invention to provide an operation starting method for introducing a yarn into a false twisting device of the belt type in a spinning machine.

It is another object of the present invention to provide a device for practicing to above mentioned method.

An embodiment of the present invention provides an operation starting method for a spinning machine of the type wherein a draft device, an air jetting nozzle and a false twisting device of the nip belt type are disposed in this order, constituted such that, in a condition of the false twisting device wherein belts are held in contact with each other at a nip point, when operation of the spinning machine is started, an air flow directed toward the false twisting device is produced on the air jetting nozzle side of the false twisting device while another air flow directed away from the false twisting device is produced on the opposite side of the false twisting device to the air jetting nozzle so that a fiber bundle after passing the draft device and the air jetting nozzle is passed between the belts of the false twisting device by the air flows forwardly and rearwardly of the false twisting device.

An operation starting method of an embodiment of the present invention may include a method in which the nip pressure of the false twisting applying faces is raised only when the yarn is to be introduced.

According to an embodiment of the present invention, a yarn introducing guide pipe in which a negative pressure is produced to produce a suction air flow between the false twisting device and the guide pipe may be located.

DETAILED DESCRIPTION OF PREFERRED EMBODIMENTS

Figure 2:
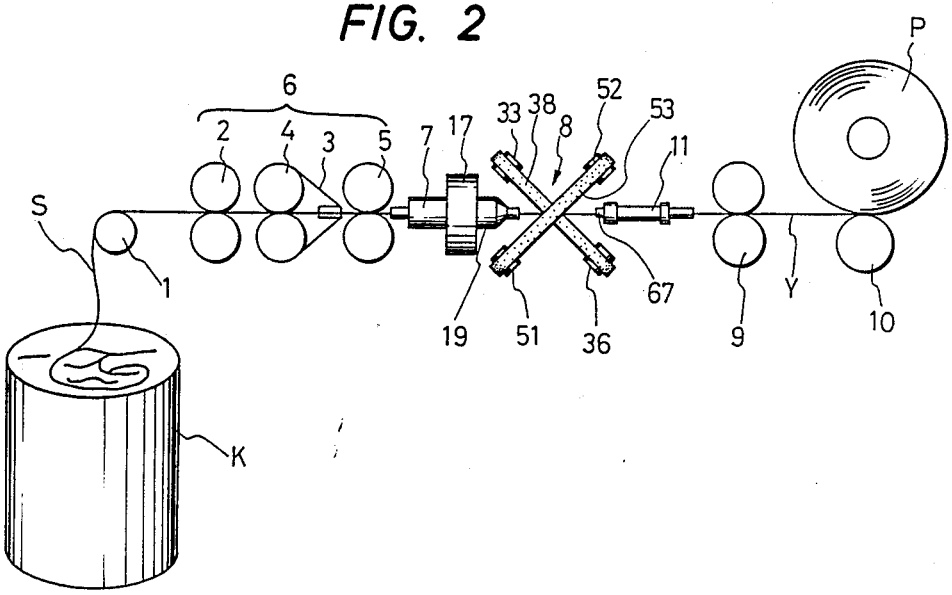

Referring to FIG. 2, untwisted slivers produced on a drawing frame and drawn out from a can K, that is, a bundle S of fibers first passes a guide roller 1 and is then introduced into a draft device 6 including a pair of back rollers 2, a pair of middle rollers 4 each having an apron 3 and a pair of front rollers 5 so that it may be drafted by the draft device 6 whereafter it passes through an air jetting nozzle 7 and a false twisting device 8 of the belt type in this order. After then, it is drawn out by a pair of delivery rollers 9 and wound on a package P which is rotated by a friction roller 10.

It is to be noted here that a device called false twisting device of the belt type or false twisting device of the nip belt type in the present invention is defined as a device which includes a pair of endless belts which intersect with each other and travel in different directions from each other such that the belts are contacted with each other at the intersecting point at which a yarn-like element is nipped between the belts to apply a false twist to the yarn-like element.

Reference numeral 11 denotes a guide pipe device which has one end connected to a suction pipe which will be hereinafter described and in which a negative pressure is produced to produce a suction air flow between the false twisting device 8 and the guide pipe device 11. The guide pipe device 11 in the present example can be expanded and contracted in a telescopic manner, and upon ordinary spinning operation, the guide pipe device 11 has a contracted configuration as shown in FIG. 2, but upon starting of operation, an inner tube of the guide pipe device 11 is projected toward the false twisting device of the belt type.

Now, the individual devices will be described in detail.

Figure 1:
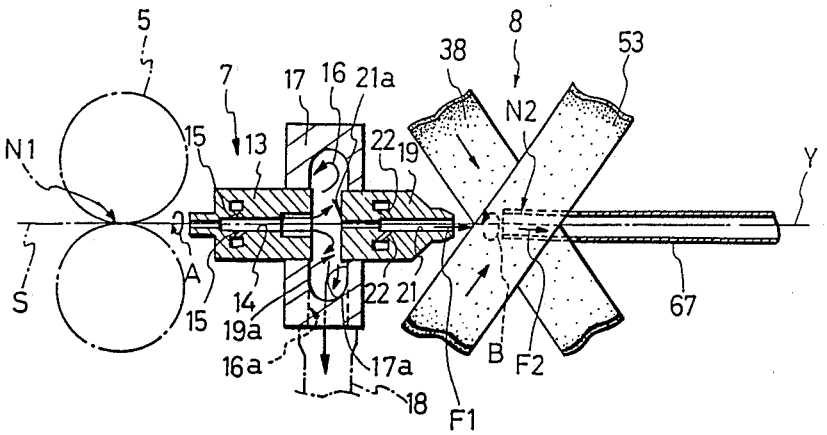
FIG. 1 is a sectional view of part of a spinning apparatus for reducing the method according to an embodiment of the present invention to practice, FIG. 2 a view showing entire construction of the same.

The air jetting nozzle 7 includes a nozzle body 13 as shown in FIG. 1 in which a fiber bundle path 14 is formed along a straight line interconnecting a nip point N1 of the front rollers 5 and another nip point N2 of the false twisting device 8 of the belt type, and a plurality of air jetting holes 15 are formed obliquely toward the false twisting device 8 of the belt type. The jetting holes 15 are formed in a tangentially inclined relationship to the fiber bundle path 14 so that compressed air jetted therefrom may advance rightwardly in FIG. 1 and flow while whirling in the direction of an arrow mark A in FIG. 1. The fiber bundle path 14 is formed such that it has a rather smaller diameter at the entrance side thereof and has a greater diameter at the exit side thereof.

A hollow shield member 17 is securely connected to the air exit side of the air injection nozzle 7 and has an inner spacing 16 which has an inner diameter about twice to that of the nozzle body of the air jetting nozzle 7. The inner spacing 16 of the shield member 17 is communicated via a wide opening **16*a* thereof to a suction device not shown by means of a pipe 18, and an exit opening of the inner spacing 16 on the side of the false twisting device 8 of the belt type is formed in a following manner in a front wall for the inner spacing 16 of the shield member 17**.

In particular, a nozzle body 19 having a same diameter with the nozzle body 13 extends through and is secured to the front wall of the shield member 17, and a fiber bundle path 21 is formed in the nozzle body 19 and serves as a fiber bundle exit of the inner spacing on the side of the false twisting device 8 of the belt type.

The fiber bundle path 21 of the nozzle body 19 has an entrance **21*a* of such a diameter that fly waste floating in the inner spacing 16 may not freely flow out therethrough, and a plurality of air jetting holes 22 are formed at an intermediate portion of the fiber bundle path 21 in an inclined relationship toward the false twisting device 8 of the belt type for producing air flows toward the exit of the fiber bundle path 21. It is to be noted that the air jetting holes 22 are formed in an inclined relationship also to tangential lines to the fiber bundle path 21 and the directions of such inclination are opposite to those of the air jetting holes 15 of the air jetting nozzle 7**.

The nozzle body 19 is secured in such a condition that it projects into the inner spacing by a little distance from the front wall of the shield member, which eliminates turbulent flows in the inner spacing 16 which may readily be produced where an end face **19*a* of the nozzle body 19 and an inner wall face 17*a* of the front wall are provided otherwise in a flush relationship with each other. Accordingly, air flows in the inner spacing 16 which are produced principally by air jetted from the air jetting nozzle 7 make relatively rectified flows which can be flowed out smoothly via the opening 21*a***.

In particular, air flows jetted from the air jetting nozzle 7 are sucked downwardly via the pipe 18, and thereupon a sucking air flow is produced near the entrance **21*a* by air flows jetted from the air jetting holes 22** so that the fiber bundle introduced into the air jetting nozzle 7 is then introduced smoothly into the fiber bundle path 21 and forwarded positively toward the false twisting device 8 of the belt type.

Now, the false twisting device 8 of the belt type of the present example will be described.

Figures 3, 4, 5:
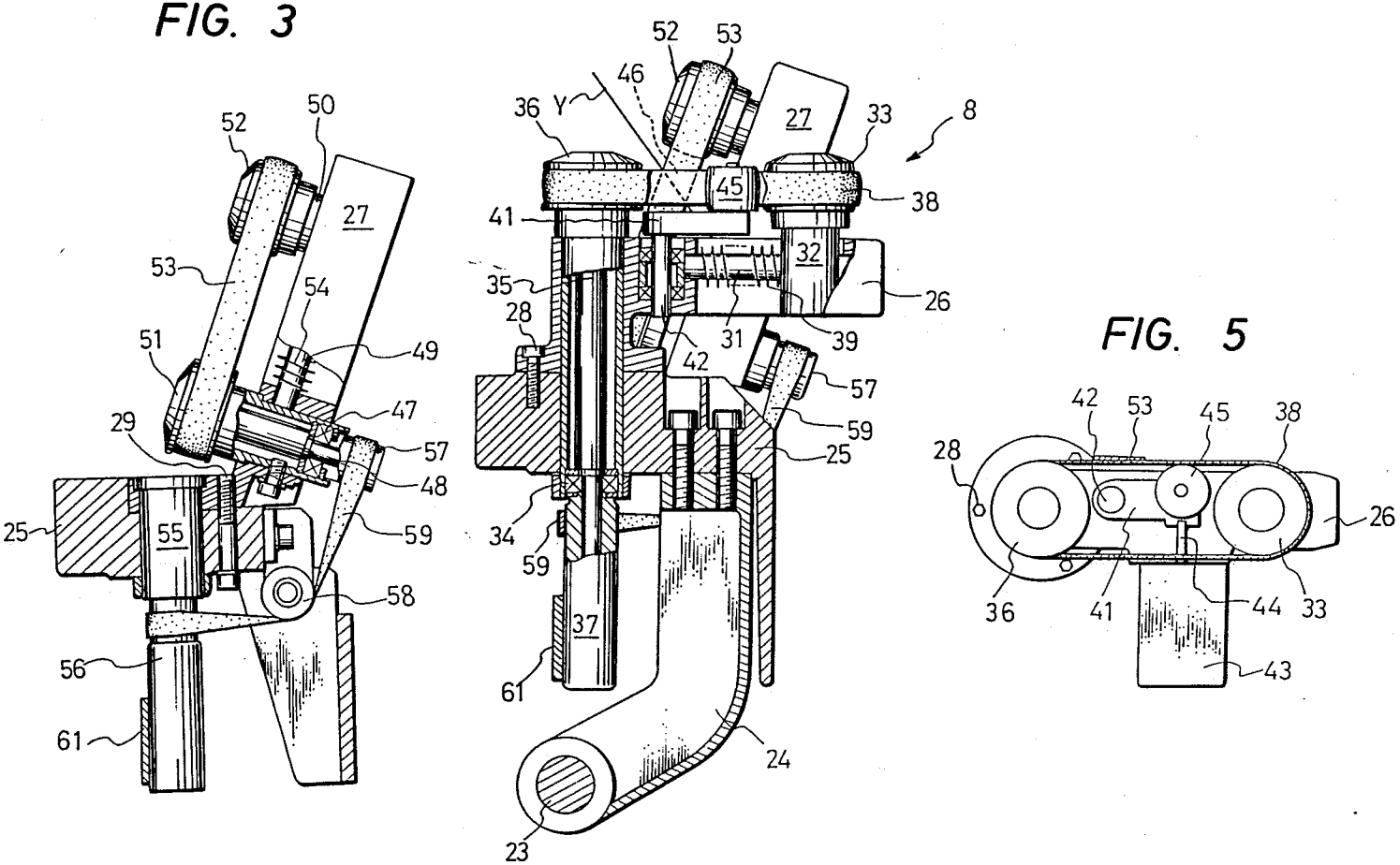
FIGS. 3 to 5 show a false twisting apparatus of the belt type, and FIGS. 3 and 4 being sectional views mainly showing a drive system for one and the other of endless false twisting belts, respectively, and FIG. 5 being a plan view on the side on which a belt pressing urging air cylinder is provided, FIGS. 6 and 7 snow a position of a guide pipe device which is mounted on the false twisting device of the belt type, and FIG. 6 being a side elevational view showing a contracted condition upon ordinary operation and FIG. 7 being a side elevational view showing an expanded condition upon yarn introduction.

In particular, referring to FIGS. 3 to 5, a support shaft 23 extends through a plurality of juxtaposed spinning apparatus, and a lever 24 is supported for pivotal motion on the support shaft 23. A base 25 is provided at the top end of the lever 24, and a first endless belt supporting arm 26 and a second endless belt supporting arm 27 are secured to the base 25 by means of bolts 28 and 29, respectively. A follower pulley 33 is supported for rotation on the first endless belt supporting arm 26 by means of a bearing member 32 which is guided for sliding movement by a guide bar 31. A first drive shaft 35 extends through and is supported on the first endless belt supporting arm 26 and the base 25 by means of a bearing 34. A drive pulley 36 is provided at the top end of the first drive shaft 35 while a motive pulley 37 is provided at the bottom end of the first drive shaft 35. An endless false twisting belt 38 extends between the follower pulley 33 and the drive pulley 36. The belt 38 is normally urged in a direction to be taut via the bearing member 32 by a spring 39 fitted on the guide bar 31.

A rockable bar 41 is supported on the first endless belt supporting arm 26 by means of a shaft 42, and also an air cylinder 43 is provided on the first endless belt supporting arm 26. A piston shaft 44 of the air cylinder is connected to a side portion of the rockable arm 41 so that operation of the air cylinder 3 may cause a rocking motion of the rockable arm 41. A pulley 45 for pressing against the belt is provided at an end of the rockable arm 41 so that it can be contacted with an inside portion of the endless false twisting belt 38 other than a false twist applying face 6 when the rockable arm 41 is rocked.

A second drive shaft 48 is provided at a base portion of the second endless belt supporting arm 27 by means of a bearing 47, and similarly to the first endless belt supporting arm 26, a bearing member 50 is supported for sliding movement on a guide bar 49. A drive pulley 51 and a follower pulley 52 are provided on the second drive shaft 48 and a shaft not shown supported on the bearing member 50, respectively, and an endless false twisting belt 53 extends between the pulleys. The belt 53 is held in a taut condition by a resilient force of a spring 54 which acts upon the bearing member 50. A motive pulley 56 is supported on the base 25 by another shaft not shown supported on the bearing member 55 while a drive shaft pulley 57 is provided at an end of the second drive shaft 48 and a drive belt 59 extends between the motive pulley 56 and the drive shaft pulley 57 past an intermediate pulley 58 supported on the base 25. The motive pulleys 37 and 56 are contacted by a drive belt 61 which extends along the length of the machine frame and to which a power is transmitted from a prime mover not shown.

The motive pulleys 37 and 56 are contacted with the drive belt 61 so that a power may be transmitted thereto from the drive pulley 61 to rotate the motive pulleys 37 and 56. By rotation of the first drive shaft 35 by rotation of the motive pulley 37, the drive pulley 36 is rotated to circulate the first endless false twisting belt 38 extending between the drive pulley 36 and the follower pulley 33. Meanwhile, rotation of the motive pulley 56 rotates the drive shaft pulley 57 and the second drive shaft 47 via the intermediate pulley 58 to rotate the drive pulley 51. By rotation of the drive pulley 51, the second endless false twisting belt 53 extending between the follower pulley 52 and the drive pulley 51 is circulated.

Accordingly, a portion of yarn Y which is held between the false twist applying faces 46 of the first and second endless false twisting belts 38 and 53 which intersect with and are pressed against each other is twisted and turned so that a false twist may be applied to the yarn Y.

In prior to such twisting, upon yarn introduction for introducing yarn (a fiber bundle) to a nip point between the false twist applying faces 46, the air cylinder 43 is rendered operative to control the pressing force of the rockable arm 41 by the piston shaft 44 to raise the nip pressure by 10 to 30% from its ordinary level. With such a raised nip pressure, even yarn of a flattened configuration at the first stage of yarn introduction can be twisted well. Thus, as time passes, a required amount of twist is applied to the yarn passing between the false twist applying faces to make yarn of a progressively rounded configuration, whereafter the nip pressure is lowered to stop increasing the amount of twist to be applied. If the nip pressure is otherwise further maintained the amount of applied twist is progressively increased and a yarn break or twisting off of the yarn may be caused.

Decrease of the nip pressure after starting, of twisting is performed by reducing the amount of the projection of the piston shaft 44 of the air cylinder 43 as time passes using a timer.

Subsequently, the guide pipe device 11 will be described.

The guide pipe device 11 is secured to the frame 25 via an arm 62 by means of screws 63 as shown in FIGS. 6 to 9. Reference numeral 64 denotes a securing bracket.

The yarn threading guide pipe device 11 is constituted from an outer tube 65, and an inner tube 67 having a sliding portion 66 for sliding contact with an inner circumferential face of the outer tube 65. The inner tube 67 extends between and is supported by an opening 69 perforated in a semi-spherical bottom portion 68 of the outer tube 65 and having a diameter equal to the outer timer of the inner tube 67 and another opening 72 perforated in a cap 71 screwed to the outer tube 65 and having a diameter equal to the outer diameter of the inner tube 67, and a cylindrical closed spacing 73 is formed between the inner circumferential face of the outer tube 65 and an outer circumferential face of the inner tube 67. A spiral spring 74 is provided in the cylindrical closed spacing 73 and surrounds the outer periphery of the inner tube 67. The opposite ends of the spiral spring 74 are arrested by the sliding portion 66 of the inner tube 65 and the cap 71, and the spiral spring 74 thus exerts an urging force in a direction to project the inner tube 67 from the semi-spherical bottom portion 68 of the outer tube 65. Further, a stepped portion 75 is formed on a face of the sliding portion 66 remote from the face at which the spring 74 is arrested.

Figure 7:
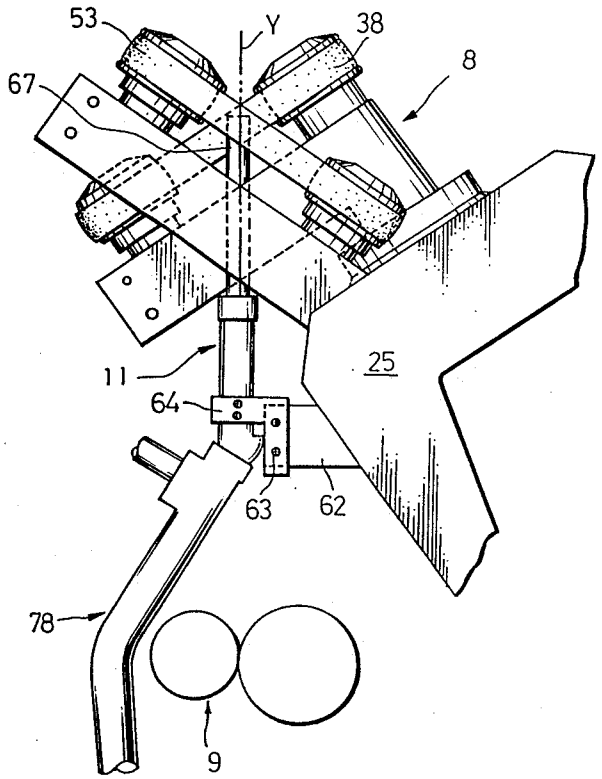
Figure 6:
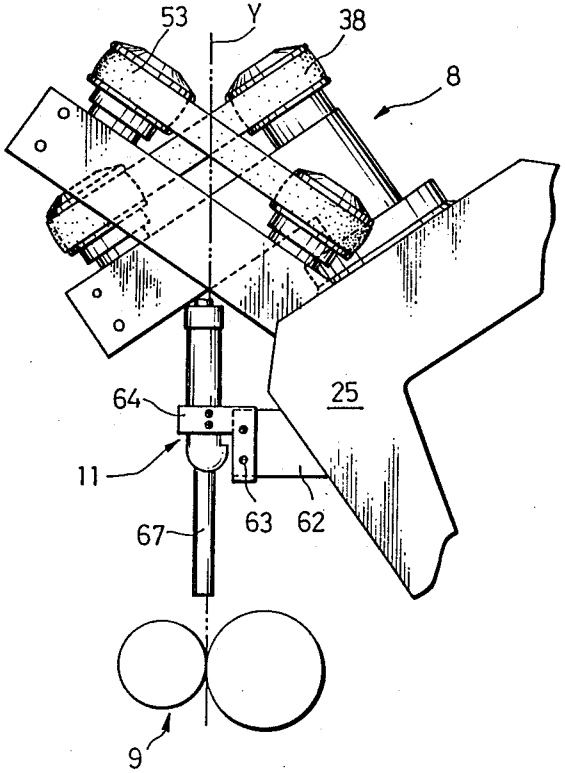
Figure 9:
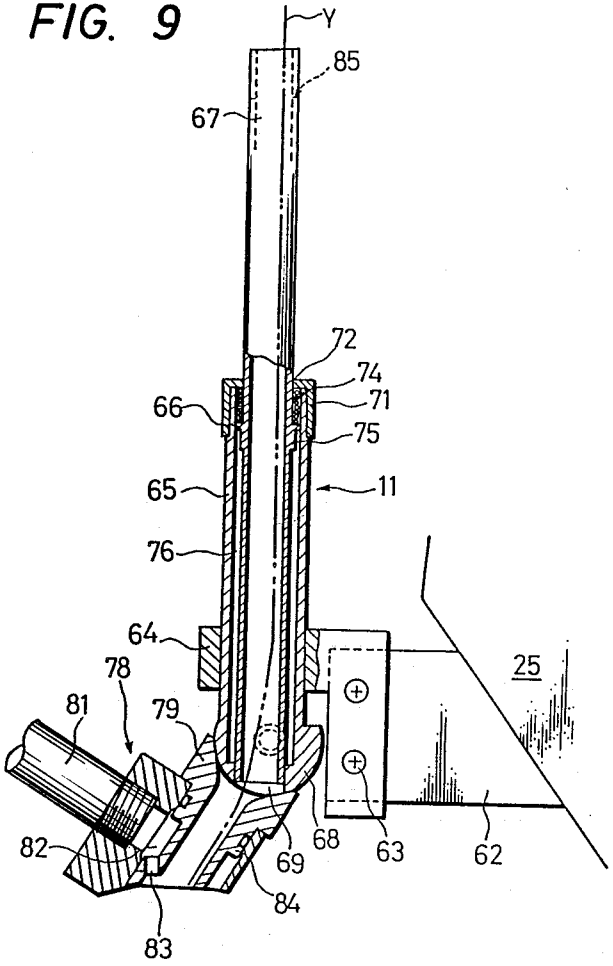
FIGS. 8 and 9 are vertical sectional views of the guide pipe device corresponding to the conditions shown in FIGS. 6 and 7, respectively.
Figure 8:
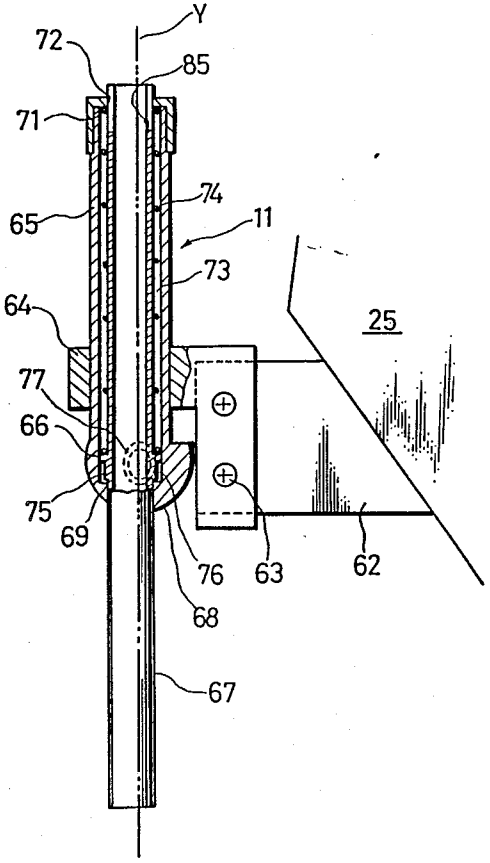

Now, in case yarn Y is broken by some cause and accordingly an end of the yarn Y is to be picked up and introduced, in response to a signal from a detecting device not shown, the stepped portion 75 of the inner tube 67 is contacted with the bottom portion of the outer tube 65 to form a pump chamber 76 shown in FIG. 8 into which compressed air is introduced through an inlet hole 77 so that the sliding portion 66 of the inner tube 65 is pressed against the urging force of the spring 74 to push up the inner tube 67. At the same time, in response to the signal, a suction pipe 78 is pivoted to fit a funnel-shaped end 79 thereof onto the semi-spherical bottom portion 68 of the outer tube 65 as shown in FIGS. 7 and 9. As a result, the end of the inner tube 67 of the yarn guide pipe device 11 reaches the nip point N2 of the false twisting device 8 at which a sucking force of the suction pipe 78 acts in the yarn guide pipe device 11 to the end of a fiber bundle S which is jetted out from the nozzle 7. Thereafter the suction pipe 78 is pivoted back to its initial position while holding the end of the yarn thereon so that the thus picked up yarn Y is nipped by the delivery rollers 9, thereby completing picking up and introduction of the yarn.

Simultaneously, compressed air which has been introduced into the pump chamber 76 to press the sliding portion 66 to push up the inner tube 67 is removed so that the inner tube 67 is moved by the urging force of the spring 74 back to its initial position shown in FIG. 8 in which the end of the inner tube 67 is spaced away from the nip point N2 of the false twisting device 8.

For sucking by the suction pipe 78, any conventional type wherein air within the suction pipe 78 is sucked by a sucking device from a base portion of the suction pipe 78 may be applied as it is. Here, however, as shown in FIG. 9, a conduit 81 is connected to an end of the suction pipe 78, and a nozzle member 84 is mounted at the end of the suction pipe 8. The nozzle member 84 has an annular air gap portion 82 and an opening 83 communicating with the air gap portion 82 and directed toward the inside of the suction pipe 78. Thus, if compressed air from the conduit 81 is jetted into the suction pipe 78 from the opening 83, a strong sucking force is produced at the opening at the end of the suction pipe 78 and acts in the yarn guide pipe device 11, by which the operation of picking up of an end of yarn and introducing the yarn can be made surer.

It is to be noted that reference numeral 85 denotes a recess formed at the end of the inner tube 67, and when the inner tube 67 is projected, the intersecting portions (false twist applying faces) 46 of the belts 38 and 53 of the false twisting device of the belt type are admitted into the recess 85. Consequently, the end of the inner tube can substantially cover, or extend over, the belt intersecting portions and accordingly a strong suction air flow can be produced at the intersecting portions 46 of the belts.

Now, an entire yarn introducing process in the apparatus described above will be described.

In particular, at first, compressed air is supplied into the pump chamber 76 to project the inner tube 67 to the intersecting portions of the belts while compressed air is jetted from the air jetting holes of the nozzle body 19 to produce an air flow F1 toward the belt intersecting portion 46 (FIGS. 1 and 4).

Subsequently, the suction pipe 78 is moved until it is contacted and fitted with the guide pipe device 11 as shown in FIGS. 7 and 9 so that a suction air flow F2 is produced at the end of the projected inner tube 67, that is, near the intersecting portions 46 of the belts, and then after lapse of several seconds (after the air flows F1 and F2 are increased to a sufficient flow rate and stabilized in this condition), the draft device 6 is rendered operative while whirling air flows are jetted from the air jetting holes 15 of the air jetting nozzle 7.

Thereupon, a suction air flow into the nozzle 7 is produced on the front roller 5 side of the air jetting nozzle 7. Consequently, a fiber bundle S coming out from the front rollers 5 is sucked and introduced smoothly into the air jetting nozzle 7 also because the distance between the front roller 5 and the nozzle 7 is progressively reduced. The fiber bundle S is introduced smoothly further into the fiber bundle path 21 of the nozzle body 19 and then jetted toward a location between the belts 38 and 53.

Since compressed air jetted from the jetting holes 15 is reduced in speed within the inner spacing 16 and is then sucked by the pipe 18, fly waste which is produced near the air jetting nozzle 7 will be sucked and removed without being scattered into the external air.

Further, since the entrance 21*a* of the fiber bundle path 21 has a reduced diameter, fly waste will generally not enter the bundle path 21, and problems which would otherwise be caused by fly waste within the inner spacing 16 passing through the path 21, jetted toward the false twisting device 8 and sticking to the belts 38 and 53 will not occur.

The fiber bundle passing through the fiber bundle path 21 and jetted toward the false twisting device 8 is then smoothly advanced to a position between the belts 38 and 53 due to the fact that air flows jetted from the jetting holes 22 are strong and the distance between the nozzle body 19 and the false twisting device 8 is progressively reduced. Then after the fiber bundle is nipped between the belts 38 and 53, it is fed rightwardly in FIG. 1 by a forwarding component of a belt moving force by the belts 38 and 53. However, since a suction air flow F2 is produced near the nip point N2 between the belts, a twist is applied to the fiber bundle at the nip point N2 so that the fiber bundle is formed into yarn Y which is then forwarded rightwardly in FIG. 1, that is, toward the delivery rollers 9, by the suction air flow F2.

It is to be noted that, when an end of a fiber bundle is to be introduced between the belts 38 and 53, the pressure of the air cylinder is raised to raise the nip pressure applied to the fiber bundle by 10 to 30% compared with the nip pressure upon ordinary operation as described hereinabove. Accordingly, even if a fiber bundle S having a flat, rather than a circular, cross section (in most cases, a flat cross section due to an influence of the nip by the front rollers) is introduced between the belts 38 and 53, such a strong twisting force that overcomes the rolling resistance of the flat fiber bundle can be applied to the fiber bundle so that the fiber bundle can be formed into good yarn having a circular cross section.

The yarn formed in such a manner as described above is then introduced to the delivery rollers 9 as a result of the pivotal motion of the suction pipe 78 to its initial position and is then wound onto a package P, thereby completing introduction of the yarn. After completion of the yarn introduction, supply of compressed air to the nozzle body 19 is stopped while supply of compressed air to the guide pipe device 11 is also stopped to restore the guide pipe device 11 to its contracted condition shown in FIGS. 6 and 8.

Since the negative pressure within the inner tube 67 is removed by the movement of the suction pipe 78 away from the guide pipe device 11, the force to forward the yarn in the guide pipe device 11 in the rightward direction in FIG. 1 is already eliminated at this point of time.

Accordingly, upon ordinary spinning operation, a fiber bundle S forwarded from the draft device 6 is exposed to a whirling flow produced by the air jetting nozzle 7 and is then passed through the fiber bundle path 21 of the nozzle body 19 as a guide path. Whereafter a false twist is applied strongly to the fiber bundle S by the belt type false twisting device 8 to form the fiber bundle S into spun yarn Y which is then passed through the guide pipe device 11 and between the delivery rollers 9 and is finally wound onto the package P.

Now, a principle of producing yarn on the apparatus described hereinabove will be described.

In particular, a false twist in the direction indicated by an arrow mark B in FIG. 1 is formed on a fiber bundle S which is forwarded from the drafted device 6 by means of the belt type false twisting device 8 and the false twist is propagated on the fiber bundle S to the nip point N1 of the front rollers 5. In the fiber bundle S just forwarded from the front rollers 5, fibers at the central portion are caught by the twist while fibers at a peripheral portion project in the form of fluff from the center of the fiber bundle without being caught. The fiber bundle S in such a condition subsequently undergoes an action of a whirling air flow within the air jetting nozzle 7 and is thus whirled or ballooned in the direction A opposite to the direction B of the twist whereupon fluffy fibers on the outer periphery of the fiber bundle are wrapped in the same direction as the whirling direction of the air flow, that is, in the opposite direction to the direction of the twist at the center of the fiber bundle. Then, when such a fiber bundle S passes the intersecting portions of the belts of the false twisting device 8, it undergoes a strong back twisting action so that fibers at the center of the fiber bundle are brought into a non-twisted or loosely twisted condition whereby the fibers around the outer periphery of the fiber bundle are wrapped further strongly around the center fibers of the fiber bundle. Consequently, the fiber bundle S is changed into a single string of bundled spun yarn Y.

It is to be noted that the position, of the belts 38 and 53, to which the inner tube 67 of the guide pipe device 11 approaches, in the embodiment described above, can be substantially the same position as that of the intersecting portions of the belts, by the provision of the recess 85 as in the example described above. Alternatively the end of the inner tube 67 may be arranged to approach as near to the intersecting portions of the belts 38 and 53 as possible without particularly providing the recess 85. In short, an air flow F1 in a direction toward the intersecting portion of the belts and another air flow F2 in a direction away from the intersecting portion of the belts are produced forwardly and rearwardly of the intersecting portion (nip point) of the belts 38 and 53 so that a fiber bundle S forwarded from the nozzle 7 may be flown on the front and rear air flows and passed between the belts 38 and 53.

Figure 10:
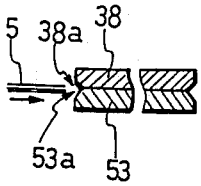
FIGS. 10 and 11 are views showing sections of the endless false twisting belts.
Figure 11:
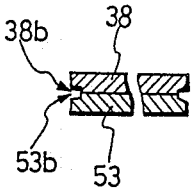

Or otherwise, in order to facilitate advancement of an end of a fiber bundle S forwarded from the nozzle 7 to the nip point of the belts 38 and 53, either inwardly directed inclined faces **38*a* and 53*a* or inwardly stepped portions 38*b* and 53*b* may be formed at least on the nozzle 7 side end faces of the belts 38 and 53 as shown in FIGS. 10 and 11**, respectively.

As apparent from the foregoing description, according to the method of the present invention, such a failure in yarn introduction upon starting of an operation as described in the beginning of the specification can be minimized in a spinning machine wherein a belt type false twisting device is used as a false twisting device.

What is claimed is:

1. An apparatus for producing spun yarn from a fiber bundle, the apparatus comprising:

a draft device including back rollers, middle rollers and front rollers, a first air jetting nozzle operable for causing a whirling air flow to act upon the fiber bundle to whirl the fiber bundle, a false twisting device having two belts operable for nipping and false twisting the fiber bundle between the two belts, the belts being arranged to travel in an intersecting relationship in different directions from each other, the belts being disposed along a path of travel of the fiber bundle, a shield member for inhibiting an air flow jetted from said first nozzle from reaching said false twisting device, the shield member being provided between the first nozzle and the false twisting device, and a second air jetting nozzle provided between the shield member and said false twisting device, the second nozzle having a fiber bundle path, wherein the shield member is provided with an opening on the second nozzle side of the shield member, the opening being formed small and wherein an air jetting hole directed toward said false twisting device is provided in the fiber bundle path of the second nozzle in communication with said opening.

2. The apparatus as claimed in claim 1, the apparatus being operable with a suction device, wherein the first nozzle has an air exit side, and wherein said shield member is securely connected to the air exit side of the first nozzle and has an inner hollow spacing provided with an opening, the inner hollow spacing being in communication via the opening with the suction device.

3. The apparatus as claimed in claim 1, wherein said fiber bundle path of the second nozzle comprises a fiber bundle exit on the side of the false twisting device and the second nozzle further comprises a plurality of air jetting holes formed at an intermediation portion of the fiber bundle path in an inclined relationship toward the false twisting device also to tangential lines to the fiber bundle path.

4. The apparatus as claimed in claim 1, wherein said belts of the false twisting device have at least one of inwardly directed inclined faces and inwardly stepped portions which are formed on the second nozzle side end faces thereof, so that the fiber bundle is easily introduced between the contacting faces of the belts.

5. The apparatus as claimed in claim 1, further comprising;

a suction pipe, and a guide pipe device provided in the vicinity of said false twisting device at an opposite side of the false twisting device with respect to the side at which the second nozzle is located, said guide pipe device being connected to the suction pipe to produce a negative pressure therein and to produce a suction air flow between the false twisting device and the guide pipe device.

6. The apparatus as claimed in claim 5, wherein said guide pipe device comprises an expandable pipe able to be expanded and projected toward the false twisting device upon starting of the spinning operation.

7. The apparatus as claimed in claim 6, the apparatus being operable with a pressure source, wherein said guide pipe device comprising:

an outer tube having an inner circumferential face, a first end, and a bottom end portion, an inner tube having a sliding portion slidable on the inner circumferential face of said outer tube and fitted in said outer tube, and a spring provided between said sliding portion and the inner circumferential face, the spring being located adjacent the first end of said outer tube for exerting an urging force in a direction to project said inner tube from said outer tube, wherein said sliding portion and an inner face of the bottom end portion of said outer tube define therebetween a pump chamber which communicates with the pressure source and in which said sliding portion serves as a pressure receiving face.

8. An apparatus as claimed in claim 1, wherein:

the shield member has a body provided with a substantially hollow interior section;

the fiber bundle path of the second nozzle is provided in communication with the substantially hollow interior section of the body of the shield member; and the opening of the shield member defines a fiber bundle inlet for the fiber bundle path of the second nozzle.

9. An apparatus as claimed in claim 1, wherein: the shield member has a substantially hollow interior section;

the fiber bundle path of the second nozzle is provided in communication with the substantially hollow interior section of the shield member; and the fiber bundle path of the second nozzle extends into the substantially hollow interior section of the shield member.

10. An apparatus as claimed in claim 9, wherein the fiber bundle path of the second nozzle comprises a body having a substantially tubular passage.

11. An apparatus as claimed in claim 10, wherein the body having a substantially tubular passage extends into the substantially hollow interior section of the shield member.

12. An apparatus for processing a fiber bundle, the apparatus comprising:

a first air jetting device having a fiber bundle passage and an air jet nozzle arranged to direct an air flow toward the fiber bundle passage;

a false twisting device having two belts operable for nipping and false twisting the fiber bundle between the two belts;

shield means for inhibiting the air flow jetted from the first air jetting device from reaching the false twisting device; and a second air jetting device having a fiber bundle passage and an air jet nozzle arranged to direct an air flow toward the fiber bundle passage, the second air jetting device being arranged between the shield means and the false twisting device.

13. An apparatus as claimed in claim 12, wherein the shield means and the second air jetting device are arranged between the first air jetting device and the false twisting device.

14. An apparatus as claimed in claim 12, wherein the shield means has a fiber bundle passage, said apparatus further comprising a fiber bundle path extending through the fiber bundle passage of the first air jetting device, the fiber bundle passage of the shield means, and the fiber bundle passage of the second air jetting device and between the belts of the false twisting device.

15. An apparatus as claimed in claim 12, wherein each belt has a fiber bundle contacting face, and the fiber bundle contacting face of at least one belt is provided with at least one of an incline or an inwardly directed step.

16. An apparatus as claimed in claim 12, wherein the first air jetting device comprises means for jetting a whirling air flow whirling in a first direction about the fiber bundle passage of the first air jetting device, and the second air jetting device comprises means for jetting a whirling air flow whirling in a second direction about the fiber bundle path of the second air jetting device, the second direction being opposite to the first direction.

* * * * *